United States Patent [19]

Oeschger

[11] 4,105,982

[45] Aug. 8, 1978

[54] VACUUM RELAY WITH REDUCED SENSITIVITY TO MANUFACTURING TOLERANCES AND OPTIONAL LATCHING FEATURE

[75] Inventor: Joseph E. Oeschger, Palo Alto, Calif.

[73] Assignee: International Telephone and Telegraph Corporation, New York, N.Y.

[21] Appl. No.: 781,681

[22] Filed: Mar. 28, 1977

[51] Int. Cl.[2] ..... H01H 1/66

[52] U.S. Cl. ..... 335/151; 335/154

[58] Field of Search ..... 335/151, 153, 154, 196, 335/235, 292

[56] References Cited

U.S. PATENT DOCUMENTS

| | | | |
|---|---|---|---|
| 3,258,559 | 6/1966 | De Lucia | 335/151 |
| 3,344,253 | 9/1967 | Roessler et al. | 335/154 X |
| 3,534,192 | 10/1970 | Miles | 335/151 X |
| 3,541,484 | 11/1970 | De Lucia | 335/196 |
| 3,576,066 | 4/1971 | Steward et al. | 228/221 |

FOREIGN PATENT DOCUMENTS

| | | | |
|---|---|---|---|
| 677,337 | 6/1939 | Fed. Rep. of Germany | 335/151 |

*Primary Examiner*—A. D. Pellinen
*Attorney, Agent, or Firm*—William T. O'Neil

[57] ABSTRACT

A hermetically sealed relay of the reed-type in which an elongated switching control rod is angularly displaced in operation. The extreme positions include internal stops, which may be contacts, in which case the switch is a single-pole-double-throw device. An attached actuator for the switch device provides tolerance-absorbing overtravel by means of uniquely arranged resilient means, such that switch-gap tolerances are effectively absorbed. The device may be of the magnetically latching type or may, in simplest form, include a single controlling electromagnet and only one fixed contact. Two embodiments are described.

3 Claims, 8 Drawing Figures

FIG. 1.
PRIOR ART
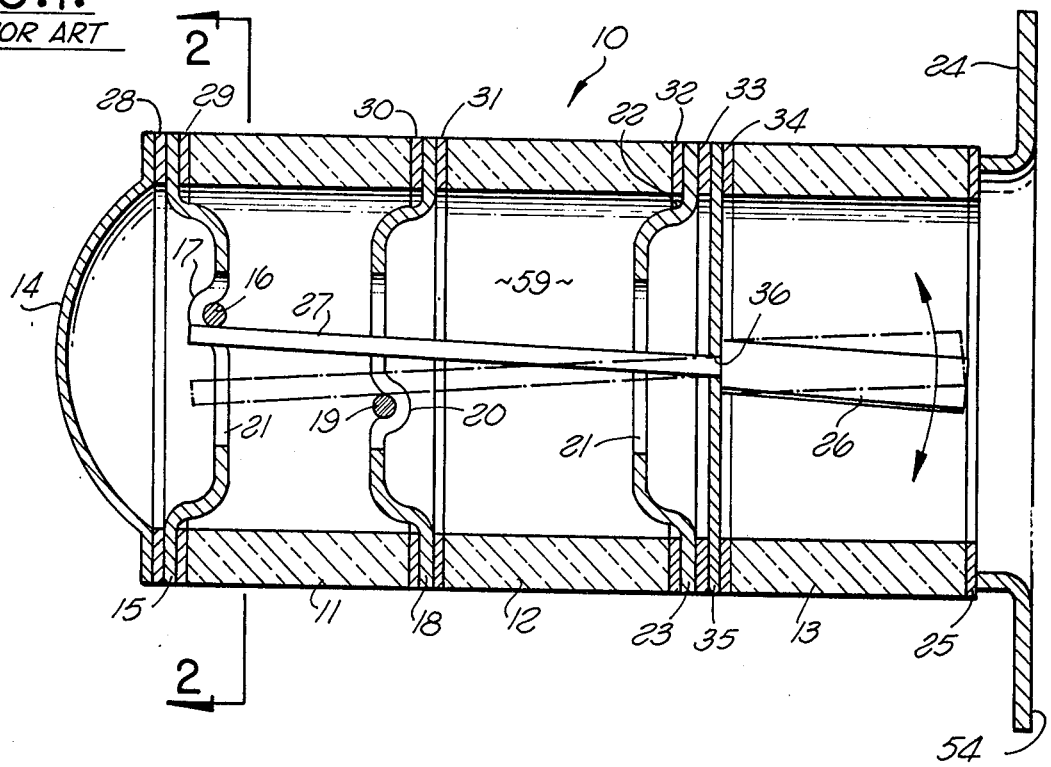
FIG. 2. PRIOR ART
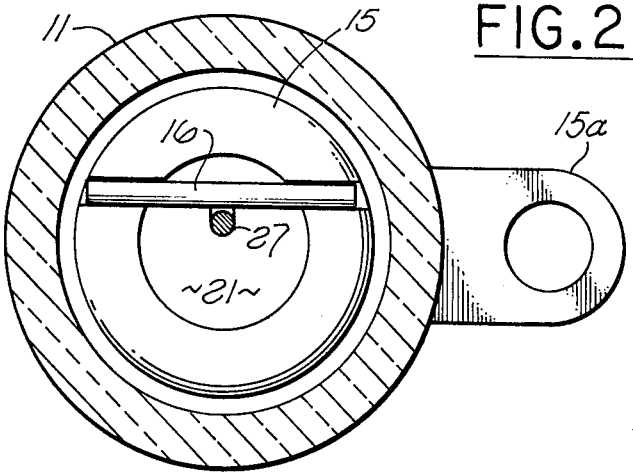
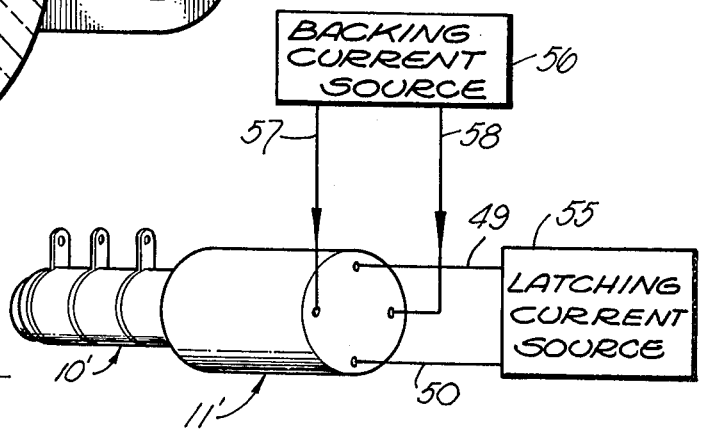
FIG. 5.
PRIOR ART

VACUUM RELAY WITH REDUCED SENSITIVITY TO MANUFACTURING TOLERANCES AND OPTIONAL LATCHING FEATURE

BACKGROUND OF THE INVENTION

U.S. Pat. No. 4,027,277, issued May 31, 1977, is a prior art form of relay apparatus for accomplishing the general purpose of the present invention, the present device having advantages thereover as will be hereinafter noted.

FIELD OF THE INVENTION

The present invention relates to hermetically sealed relays, and is adapted to vacuum or gas-filled relay technology with or without a latching capability.

DESCRIPTION OF THE PRIOR ART

Vacuum type and other sealed relays of the general class and performing the general functions provided by the combination of the present invention are known. U.S. Pat. No. 3,576,066 illustrates and describes such a relay as known in the prior art, with particular emphasis on processes useful in its manufacture.

Although devices of the general type are usually thought of as vacuum relays, they can be constructed as gas-filled switching devices, if desired.

Prior art devices of the type to which the present invention applies generally comprise two separately manufactured subassemblies prior to final assembly. One of these subassemblies is the hermetically sealed switch assembly itself, and the other is the actuator assembly. In the aforementioned U.S. Pat. No. 3,576,066, the first of these subassemblies is typically illustrated in FIG. 2, and the second in FIG. 5.

Although the present invention is not confined to the use of stacked ceramic cylinders forming the evacuated switch enclosure, that type of construction is well known in the prior art and affords significant manufacturing advantages, vis-a-vis, blown-glass bulb enclosures or the like.

Prior art actuators of the required type have taken several basic functional forms, including those which provide latching in first and second controlled positions by mechanical means and those providing magnetic hold in first or second positions to achieve a similar latching effect. These prior art actuator arrangements have also operated against discrete internal limits, i.e., against their own internal stops, and it therefore has been necessary to very carefully control the switch gap in the mating vacuum switch part so that the switch contacts in one or both directions will be effected with some residual force. Once the vacuum switch enclosure is fully assembled and sealed, it is not possible from a practical point of view to adjust the switch gap (i.e., the spacing between the two switch positions), and if the actuator does not provide an appropriate "overtravel" to absorb at least a portion of the switch contacts at the alternate positions, the manufacturing reject rate is likely to be high and the life of the assembly and vacuum brazing tools and fixtures quite limited.

In the prior art actuators of the type, the overall performance characteristics cannot be appropriately evaluated or production tested until after final assembly to the vacuum switch housing. Therefore, previously undetected dirt or foreign matter in the actuator may cause its rejection along with that of the switch enclosure, since the prior art actuators are not readily opened for cleaning or inspection.

Where the actuator operates against a definite stop within itself in each of two positions, any effort to relieve its own tolerance problems can result in loose parts. The same may be said of the switch assembly, per se.

Thus, the prior art arrangements in which both the switch assembly and the driving actuator operate against their own definite internal stops gives rise to manufacturing problems, particularly in respect to tolerances.

The manner in which the present invention deals with the problems of the prior art to produce a novel and improved overall device will be evident as this description proceeds.

SUMMARY OF THE INVENTION

In accordance with the disadvantages and problems of the prior art, it may be said to have been the general objective of the present invention to produce a hermetically sealed relay of the type described, which may be constructed as a simple electromagnetically controlled switch of simple form, or as a latching relay, in an arrangement which is relatively insensitive to manufacturing tolerances, including those induced by tooling wear, and the normal tolerances of the component parts themselves.

The invention applies typically to the type of hermetically sealed relay constructed from a plurality of stacked hollow cylindrical sleeve sections of insulating material (most commonly of ceramic material). This assembly of insulating sleeve sections forms an elongated enclosure or housing. The sleeve sections are furnace-brazed (preferably in a vacuum), the end surface annulus of each such sleeve section having been prepared for sealing according to a well-known procedure in this art. The electrical terminal structure is integrally sealed between the sleeve sections, that terminal structure also providing the support means for the internal contacts. One end of the enclosure is capped in the process and the other is sealed by means of a flexible conductive diaphragm member, through the center of which a switching control rod or rod member generally axially extends within the sealed housing and for a small distance outside the diaphragm. That portion of the overall structure generally comprises the sealed switch assembly, and is manufactured independently of the actuator.

The bars which comprise the fixed contacts also provide fixed stops against which the switching rod member rests in each of the two discrete angular positions thereof.

The separately manufactured actuator is capable of angularly controlling the external end of the said switch rod member when mated to the sealed switch assembly. Within the actuator, a clapper is drawn to a pole piece in response to energization of a cooperating electromagnet, the clapper is formed of magnetic flux-transmissive material as is the pole piece and the housing surrounding the coils and pole piece. The pole piece is generally axially disposed along the centerline of the actuator device, which is substantially also the centerline of the switch enclosure, when these are mated together in final assembly. When the electromagnet is deenergized, a spring pushes against a relatively rigid portion of a mechanical linkage extending generally axially and normally from the surface of the clapper, to urge the clapper away from the pole piece, i.e., rotate it about pivot point along one edge of the said clapper.

The aforementioned member, which is a portion of the mechanical linkage between the actuator proper and the switch rod member, extends and engages laterally against the said rod member and includes additional resilience serving to provide an "overtravel" or residual pressure tending to keep the switch rod member firmly in the corresponding angular limit position against the corresponding stop within the switch structure. The actual switch rod engagement part comprises a relatively resilient leaf spring member and provides the additional resilience. When the clapper position is against the aforementioned pole piece, corresponding to energization of the electromagnet, this leaf spring will be slightly deflected, thereby providing the same type of residual pressure against the switch control rod member as provided in the other clapper position by the first-mentioned spring. In this way, the so-called "switch gap" tolerance may be absorbed in each of the two switch positions.

The magnetic actuator itself may include, in addition to the electromagnet, a second electromagnet and one or more permanent magnets contributing flux to the same magnetic circuit, i.e., through the center pole piece, through the clapper, and returning to the other side of the pole piece through the magnetic flux transmissive housing containing the actuator magnetic components as aforementioned.

The device may thereby be constructed as a "latching" relay, the permanent magnet flux being sufficient to hold the clapper seated against the pole piece against the first spring means force in the absence of energizing of either of the electromagnets. The permanent magnet field intensity is not sufficient, however, to draw the clapper into position against the first spring means from the "clapper open position" corresponding to the other switch control rod member angular position. One of the two electromagnets is designed to provide sufficient augmentation of the permanent magnet field to draw the clapper against the pole piece. That electromagnet need only be momentarily energized, since the permanent magnet field thereafter holds the clapper in that "closed" position, as aforesaid. The other electromagnet provides a bucking field upon momentary excitation so as to cancel at least a sufficient portion of the permanent magnet field to permit the clapper to be restored to the "open" position by the first spring means. Thus, that particular variation of the basic combination of the present invention provides a latching relay.

It will be realized as this description proceeds that the relay in accordance with the present invention is basically most adapted for single pole, single throw (SPST), or single pole, double throw (SPDT) configurations.

Other improvements over the prior art will be noted as this description proceeds.

BRIEF DESCRIPTION OF THE DRAWINGS

FIG. 1 is a sectional view of a prior art sealed switch subassembly of a relay for use in the combination of the present invention.

FIG. 2 is a sectional view taken orthogonally through FIG. 1 as indicated.

FIG. 5 is a block diagram showing a typical relay in the latching variation with sources of latching and bucking current.

DESCRIPTION OF THE PREFERRED EMBODIMENT

Figure 3:
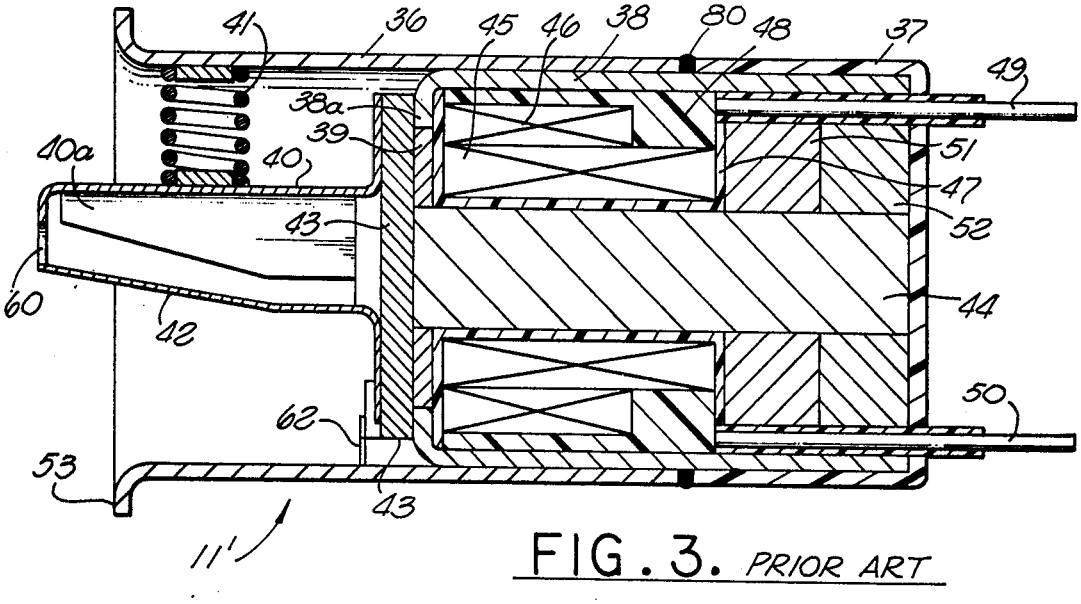
FIG. 3. PRIOR ART
FIG. 3 is a sectional view of the actuator and mechanical linkage subassembly according to a prior art arrangement.

Referring now to FIG. 1, the switch subassembly of a relay for use in the combination of the present invention will be described. A vacuum relay form of this element will be described.

The switch subassembly of FIG. 1 is identified generally at 10 and comprises three of the hollow cylindrical shell ceramic body or housing members 11, 12 and 13 which form the insulating portions of the sealed enclosure. These ceramic hollow cylinder members may be joined either by hydrogen furnace brazing with subsequent defusion exhaustion of the hydrogen or in a vacuum furnace, the latter being preferred. To carry out the brazing process, the parts illustrated in FIG. 1 are assembled in a V-grooved jig composed of graphite or other material of similar characteristics. The V-groove may be tilted slightly so that the parts tend to be held together axially by gravity during the brazing process. End sealing is effected by the metallic cap 14 on one end and by the diaphragm 35 on the other end. Cupped flange parts 15, 18 and 23, having outside diameter substantially the same as that of the hollow cylindrical ceramic body parts, are brazed to the prepared ends of these ceramic parts, and in the case of the cap end, the cup flange 15 and end cap 14 are brazed together. As the parts illustrated on FIG. 1 are assembled into the brazing jig, annular discs ("washer-like" parts) of brazing material are inserted, particularly at 28, 29, 30, 31, 32, 33, 34 and 25. The flange part 24 is brazed to the ceramic part 13, thereby providing convenient means for connecting the actuator to the finished switch device.

A switching rod member 27 of a conductive material, which is relatively hard and possessed of known desirable electrical contact characteristics, such as one of the refractory metals (i.e., titanium tungsten molybdenum or one of the alloys known for the purpose). At 36, this conductive rod 27 is affixed to an insulating sleeve 26 (preferably of a ceramic material similar to that of parts 11, 12 and 13), to provide an insulating mechanically controllable free end for switching control. At 36, the rod passes through a central aperture formed in the flexible diaphragm 35 and is hermetically brazed thereto. The flexibility of diaphragm 35 permits the angular displacement of rod 27 between the extremes or stops provided by contacts 16 and 19.

Referring also to FIG. 2 for clarity, it will be seen that these contact rods 16 and 19, which are ordinarily of the same material as rod 27, are brazed or welded in place in corresponding convolutions 17 and 20 in the respective cup flange parts 15 and 18, respectively. Each of the cup flange parts aforementioned has a central opening typically 21, through which rod member 27 passes.

The technical literature of the prior art, including U.S. Pat. No. 3,576,066 aforementioned, contains additional information regarding materials for the various parts of the switch subassembly 10. The end cap 14 would normally be of metallic material (such as nickel) permeable to hydrogen at high temperatures if the hydrogen atmosphere furnace brazing operation with subsequent diffusion processing to remove the hydrogen is employed. In the preferred vacuum brazing operation, however, there is no such requirement for the material of the end cap 14, and it may therefore be selected in accordance with environmental performance requirements and suitability for withstanding the temperatures of the vacuum brazing operation, as a matter of design choice. Much the same design choice applies to the selection of the cup flange parts, typically 15 with its integral connection lug 15*a*.

In accordance with the foregoing, it will be noted that a single brazing operation effects the sealing and mechanical assembly, and it emerges therefrom ready for assembly to the actuator device. The emplacement of the fixed contact rods 16 and 19 to the respective parts 15 and 18, as well as the hermetic sealing of the rod 27 to the diaphragm 35 and 36, are best accomplished prior to the vacuum furnace brazing operation by individual welding or brazing operations. The mechanical joint between 27 and 26 at the joint 36 is outside the evacuated interior of the switch assembly, and there is no requirement for hermetic sealing at that point, the diaphragm 35 having already been sealed to 27. Brazing onto a prepared surface of 26 can be employed, however, a properly chosen industrial adhesive is capable of providing this function. In any event, the exposed end of 26 to the right of the diaphragm 35, as viewed on FIG. 1, provides the opportunity of installing the insulating sleeve part 26 after completion of the vacuum brazing step, the part 26 then mechanically becoming a part of the switch control rod.

Referring now to FIG. 3, a prior art actuator with integral mechanical linkage for connecting it to the switch rod assembly 26 is seen generally at 11'. The discussion and explanation of FIG. 3 will be undertaken in connection with the end view, FIG. 4, for maximum clarity.

The actuator embodiment depicted in FIG. 3 is that involving two electromagnet coils 45 and 46 and a pair of permanent magnets 51 and 52, all of these being capable of contributing magnetic flux to essentially the same magnetic circuit, comprising the centerpole piece 44, clapper 43, the magnet housing 38 (including the inwardly turned lip 38*a*), and back through the permanent magnets 51 and 52 to the centerpole piece 44 to form a complete loop.

It should be understood that, although the actuator structure being described is the "latching" version, the invention is also applicable to the simplest format in a relay, namely, the single electromagnet nonlatching version. In such a device, only a single electromagnet coil, for example 45, need be used, and this might occupy the space devoted to 45 or 46 on FIG. 3. Also, the permanent magnets on the right beyond the magnet coil spool edge 47 would be replaced by a return magnetic circuit plate (not shown), bridging the pole piece right end to the open right end of housing 36, 37 would be omitted in such a version.

The clapper 43 is illustrated in its "closed" position, i.e., drawn against the end of the pole piece 44, and the permanent magnets 51 and 52 are sufficiently strong to retain it in that position. The parts of the magnetic circuit, including the clapper 43, the magnet assembly housing 38 and the pole piece 44 are to be understood to be materials of relatively high magnetic flux transmission capability but of low retentivity. The permanent magnets 51 and 52 are the exception to this, however, in that they must also exhibit high retentivity, a characteristic well understood in connection with permanent magnets.

Let it be assumed that neither electromagnet coil 45 nor 46 is energized, and the clapper 43 being in the (closed) position illustrated, the actuator is controlling the switch subassembly into one of its two switch positions. A relatively rigid, or inflexible, mechanical linkage member 40 having side stiffening gussets 40*a* extends leftward (as seen on FIG. 3) essentially with its top surface parallel to the axial centerline of the actuator. The opening at the end, identified as 60, will be seen to be shifted upward with respect to the said axial centerline. Since the completed device involves the attachment of the flange 53 of the actuator shell 36 to the surface 54 of flange 24 (see FIG. 1), thus in the closed clapper position, the right end of the switch rod sleeve 26 would be mechanically urged upwardly as seen on FIG. 1, and the rod 27 left of the diaphragm fulcrum point 36 would be correspondingly urged downward into contact with 19.

Figure 4:
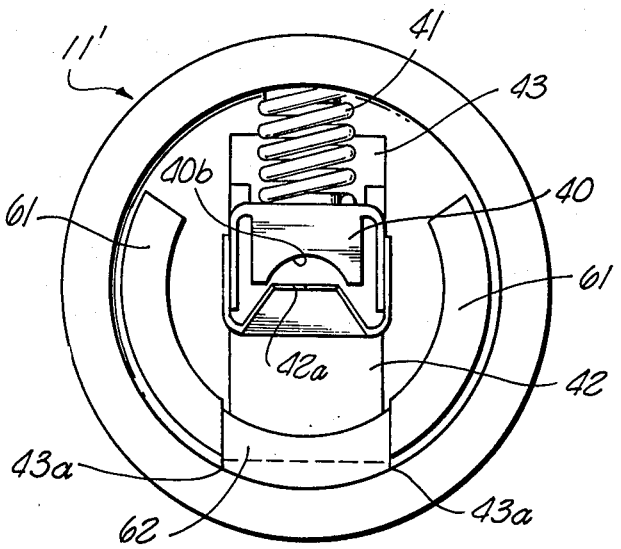
FIG. 4. PRIOR ART
FIG. 4 is an end view of the actuator and mechanical linkage of FIG. 3.

From FIGS. 3 and 4, it will be seen that leaf spring part 42 would be resiliently "down-sprung" in order to accommodate the circular cross-section of part 26. Depending upon the tolerance conditions all around, the part 26 might ride (in that situation) less than completely seated in the arcuate opening 40*b* at the top of the opening 60. Thus, there is residual mechanical force tending to keep the rod 27 in firm contact against contact 19, irrespective of nominal tolerance variations in the switch and actuator. The end lip 42*a* of the leaf spring 42 may also be made slightly concave as a design variation.

It will be understood that the compression spring 41 exerts a force against 40, tending to cause the clapper 43 to rotate "open" about the pivotal points 43*a*, however, it is not a sufficiently great force to counteract the latching force exerted by the permanent magnets. If the smaller electromagnet coil 46 is momentarily energized in the bucking current direction (i.e., so as to create a flux opposing that of the permanent magnets) then the net magnetic retention force action on the clapper 43 is reduced to the point where the spring 41 can operate to rotate the clapper about the said points 43*a*. In that event, the opening 60, which accommodates the rod sleeve 26 of the switch subassembly, is shifted downward as viewed on FIG. 3. The result is that the rod 27 changes to a position in contact with 16. In that case, the spring 41 exerts a residual force tending to hold it there and overcoming any tolerance buildup which might otherwise prevent positive switch contact pressure. This capability for "overtravel" of the mechanical linkage comprising the parts 40 and 42 basically, thus employs both the spring 41 and the resilient (leaf spring) member 42 to effect the aforementioned contact retention force in both switch positions.

Once the switching operation corresponding to clapper "open", clapper 43 has rotated about 43*a* away from the pole piece, and here the permanent magnet flux is not sufficient to pull the clapper 43 back against the pole piece 44 against the force of spring 41. It is, of course, well known, that as the gap in a magnetic circuit increases, a larger magnetomotive force is required to produce an equivalent flux, vis-a-vis, that required to produce the same flux in a minimum or zero gap situation.

If the larger electromagnet coil 45 is next momentarily energized so as to produce a sufficient magnetic force aiding that of the permanent magnet, the clapper 43 will be again drawn against the pole piece 44 and will remain there because of the retention force exhibited by the said permanent magnets around the aforesaid magnetic circuit, even though the electromagnetic coil 45 is only momentarily energized.

As illustrated on FIG. 3, the space 48 comprises a keeper of nonmagnetic insulating material for preserving the magnet coil alignment illustrated. Electrical leads 49 and 50 are shown for the sake of completeness, these being only two of four required for the two electromagnet latching versions illustrated, as will later be seen more clearly in connection with FIG. 5.

A washer 39, of nonmagnetic material, such as monel, may be brazed through its center hole over the end of the pole piece 44 to serve as a mechanical closure over the clapper end of the electromagnet assembly. It is necessary that this part be non-magnetic in order to avoid "short circuiting" the magnetic flux which it is desired to have pass through the clapper 43.

The more or less rectangular nominal shape of the clapper 43 may be observed from FIG. 4, however it will be realized that this shape is arbitrary and a matter of design choice only.

A keeper 61 of partial circular shape as illustrated in FIG. 4, has a raised portion 62 acting as a retainer for the clapper 43 by forming a pocket as seen from FIGS. 3 and 4. This expedient is more important as an assembly convenience than a functional necessity once the switch and actuator subassemblies are fully mated. This pocket formed by the raised portion of 61 at 62 is sufficiently loose to avoid binding of the clapper in the vicinity of the pivot points 43*a*. The keeper portion 61 may be readily attached, as by spot welding to the magnet assembly housing lip 38*a*.

The completed switch and actuator sub-assemblies 10 and 11′ respectively, are very conveniently mated by first applying several spot welds through the actuator housing flange 53 and the switch sub-assembly flange 54. Thereafter, if required, heliarc welding, external brazing or the like, can be applied to environmentally seal the assembly, although only the interior of the switch sub-assembly between the end cap 14 and the diaphragm 35 (comprising the space 59) is normally hermetically sealed. An end-bell 37 joined by an adhesive seal 80, serves as a protective cover at the other actuator end and would normally be of non-magnetic metal material in the arrangement as illustrated in FIG. 3, although that is not a functional requirement.

Referring now to FIG. 5, a pictorial view of the typical assembly of switch sub-assembly 10 and actuator sub-assembly 11, is shown. In the embodiment depicted in FIG. 3, four leads, i.e., two for each of the magnet coils 45 and 46, are usually required, unless one leg of each coil is considered "common", in which case only three external leads need be used.

It may be assumed that leads 49 and 50 from the source of latching current 55 lead to the larger coil 45, i.e., the electromagnet capable of drawing in the clapper 43 from its "open" position. Leads 57 and 58 are shown in FIG. 5 conducting current from a bucking current source 56 to the smaller coil 46, i.e., for producing the relatively small cancellation or bucking flux necessary to overcome the retentive effect of the permanent magnets in order to release clapper 43 from the "closed" position illustrated and allow spring 41 to rotate it and the parts of the aforementioned mechanical linkage about the pivot point 43*a*, as already described.

Figure 6:
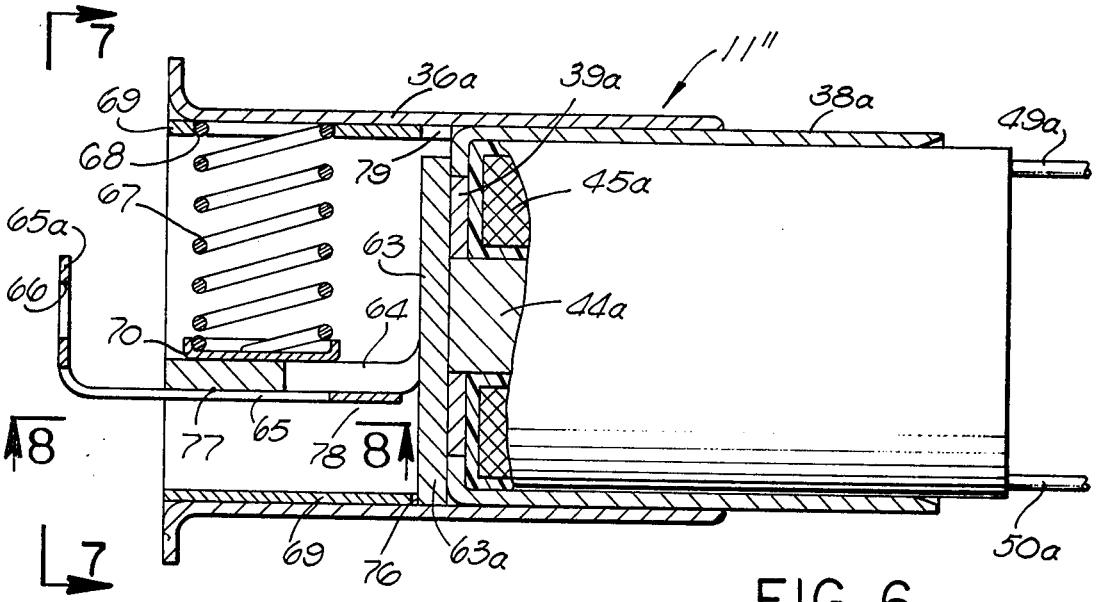
FIG. 6 is a sectional view of an actuator and mechanical linkage according to a the invention.
Figure 7:
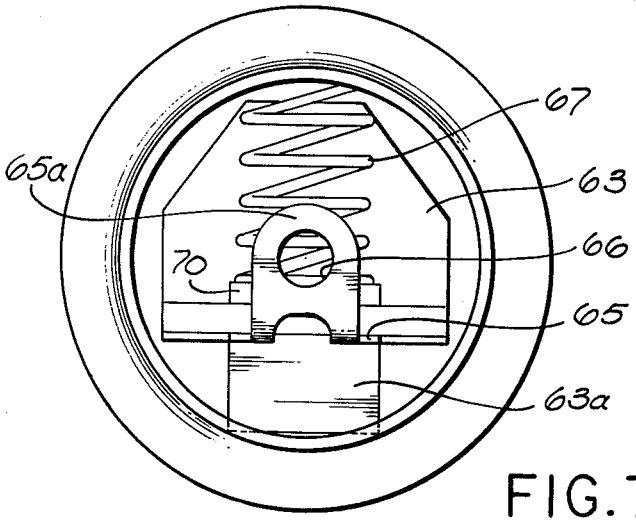
FIG. 7 is an end view, as indicated, taken from FIG. 6.
Figure 8:
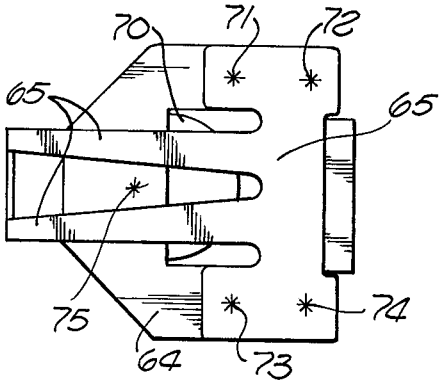
FIG. 8 is a further partial view of FIG. 6, as indicated.

Referring now to FIGS. 6, 7 and 8, the actuator and mechanical linkage (generally at 11″) will be described as they are for the improved combination of the invention. This arrangement affords certain advantages, vis-a-vis, the actuator and mechanical configuration described in FIG. 3. Insofar as its application to the switch "bottle" of FIG. 1 is concerned, the actuator and mechanical linkage assemblies of FIGS. 3 and 6 are interchangeable. Like parts carry the same identifying numerals among the illustrations.

The actuator mechanical linkage device of FIG. 3 provides for the gripping of the switch subassembly control rod 26 on either side thereof in a type of zero force play arrangement, as already described. In instances where the operating voltages are relatively high, the projected edges of parts 42*a* and 40*b* (as seen in FIG. 4) can produce a localized high voltage stress, with resultant localized corona. The invention embodiment of FIGS. 6, 7 and 8 employs a different design more suitable for higher voltage applications in that the overtravel spring 65 has an orthogonally oriented end 65*a* with a clearance hole 66 therethrough. The switch subassembly control rod 26 fits sufficiently loosely through the hole 66 so that no binding occurs at either angular extreme of the rod 26, corresponding to either the closed or opened position of the clapper 63. The additional play introduced, as compared to that extant in the FIG. 3 configuration at that point, is readily compensated for by the overall tolerance-absorbing characteristic of the design, this being a significant overall feature of the invention.

The embodiment of FIG. 6 will be seen to permit the use of a longer, larger diameter spring 67 having a lower spring rate selectable from a broader group of commercially available springs. This longer, larger diameter spring 67 is also less sensitive to the relative locations of its mounting surfaces and makes possible a somewhat more relaxed spring rate and mounting surface tolerance situation.

Still further, the novel arrangement depicted in FIGS. 6, 7 and 8 provides inherent freedom from spot-weld-induced distortion of the clapper magnetic interface surface (i.e., against the pole piece 44*a* and the other magnetically active parts of the magnet structure). This is accomplished by confining the spot-welds to the orthogonally oriented projection 64 of the clapper 63. Such welds are in the vicinity of 78 as seen on FIG. 6 and are more specifically shown as spot-welds 71, 72, 73 and 74 on FIG. 8.

Spot-welding directly to any part of the coil housing face has also been eliminated from FIG. 6 in order to obviate the possibility of any weld-induced distortion from that source. To produce the same clapper and spring-retaining functions as provided in FIG. 3, an inner sleeve 69 is press-fitted or otherwise secured within an outer actuator housing member 36*a*. This inner sleeve 69 has a side wall hole at 68 within which the spring 67 nests against the inside surface of 36*a*.

It will be noted that an annular cavity 79 is formed because the inner sleeve 69 is not inserted into complete contact with the radius portion of the magnet housing 38*a*. This provides a capture groove for the clapper lower portion 63*a*, with a small gap 76 remaining.

A cup 70 receives the bottom end of the spring 67, as shown on FIG. 6. This cup 70 may be spot-welded, typically at 75, to the top of the clapper axially extending portion 64, as also seen in FIG. 6. This spot-weld 75 may, for example, be in the location illustrated at 75 in FIG. 8.

It will be noted, particularly from FIG. 7, that the right angle portion 65*a* of the overtravel spring 65 has a rounded edge configuration, for minimum corona generation. It will also be noted, especially from FIG. 8, that the overtravel spring 65 is actually bifurcated in order to provide an appropriate leaf spring characteristic without making the spring metal thickness thereof unduly thin and fragile.

In operation, the device of FIG. 6 is illustrated with the clapper 63 drawn against pole piece 44*a*. The spring 67 would then be under maximum compression and on FIG. 6, the overtravel leaf spring 65 would actually be deflected downward away from 64, producing a gap at 77 and thereby resiliently maintaining the switch subassembly control rod 26 in one extreme position, the said 26 extending through the hole 66, of course.

The functions of 44*a*, 45*a*, 49*a* and 50*a* are the same as 44, 45, 49 and 50 in FIG. 3. FIG. 6 is actually illustrated with only a single actuating coil 45*a*, rather than with 45 and 46 as shown in FIG. 3, it being understood that this is indicative of an alternate electromagnetic actuating option as hereinbefore referred to.

The functions of 38*a* and 39*a* are to be understood to be equivalent to those of 38 and 39, as described in connection with FIG. 3.

In the other extreme of operation of the device in FIG. 6, the clapper 63 would be away from the pole piece 44*a*, pivoting about its lower corner adjacent to the gap 76. The overtravel leaf spring 65*a* would, in this case, be snug against 64 (no gap in the vicinity of 77), and the spring 67 would provide the residual force against the switch subassembly control rod 26 in that situation.

A number of variations will suggest themselves to those skilled in this art, once the concepts of the present invention are fully appreciated. Accordingly, it is not intended that the drawings or this description should be considered as limiting the scope of the invention, the said drawings and specification being typical and illustrative only.

Certain additional features of interest and practical importance which are prior art per se, are pointed out to the skilled reader. For example, the cupped flange contact supports, such as 15, provide an inside baffling effect tending to reduce the tendency for corona to develop within the evacuated space. While it is known, for example, from the aforementioned U.S. Pat. No. 3,576,066, and also U.S. Pat. No. 4,027,277 to cup the contact supports, an improvement in the structure of the present device has been effected by also cupping the part 23. Thus, the surface at point 22 tends to retain the shape of the brazing material washer 32 during the furnace braze operation, to avoid the development of sharp points and irregularities which tend to give rise to internal corona.

Further, prior art devices have frequently used a reentrant type seal whereby the flange part 24 is joined to the outside circumference of ceramic part 13. In the present device, a so-called "cookie-cutter" seal (also known per se) is made between 13 and 24 and the need for a specially prepared ceramic part 13 is thereby eliminated. Accordingly, the ceramic parts 11, 12 and 13 may be identical.

What is claimed is:

1. A relay comprising:

an axially elongated enclosure having a longitudinally extending axis and including at least one internally disposed fixed contact and a fixed external terminal conductively connected to said contact, said enclosure having a flexible conductive diaphragm at one end thereof;

a conductive switching rod member passing through said disphragm generally normal to the plan thereof and being mechanically and electrically connected thereto, said rod member extending externally and also generally axially within said enclosure, said rod member providing switching action in cooperation with said fixed contact as a function of variation of the angular position of said rod member with respect to said axis of said enclosure;

an actuator device connected to the portion of said rod member external to said enclosure to control said angular position of said rod member to effect switching action between said rod member and said fixed contact;

means within said actuator including at least a first electromagnet, a clapper of magnetic material arranged to assume a predetermined magnetically induced first position in response to energization of said first electromagnet, and a mechanical linkage arranged for transferring motion of said clapper to angular motion of said rod member substantially about the point of passage of said rod member through said diaphragm as a fulcrum;

means within said mechanical linkage comprising a projection attached to said clapper and extending generally parallel to said longitudinally extending axis when said clapper is in said first magnetically induced position;

first resilient means comprising a leaf spring associated with said projection for maintaining a residual resilient force retaining said rod member in a first position with respect to said fixed contact while said clapper is in said first magnetically induced position, said leaf spring having an orthogonally turned second end with a hole therethrough receiving said rod member, said leaf spring being arranged to deflect with respect to said projection, thereby maintaining residual resilient force against said rod member in its first position when said clapper is in said magnetically induced position;

and second resilient means associated with said mechanical linkage for maintaining a residual resilient force retaining said rod member in a second position with respect to said fixed contact while said clapper is in a second position corresponding to deenergization of said electromagnet, said second resilient means also serving to separate said clapper from the pole piece of said electromagnet.

2. Apparatus according to claim 1 in which said second resilient means comprises a compression coil spring operative between said clapper projection and said axially elongated enclosure, said coil spring exerting residual resilient force against said rod member in its second position when said clapper is in said second position.

3. Apparatus according to claim 2 in which said clapper projection is offset with respect to the axial centerline of said elongated enclosure to provide a relatively large volume for containing said coil spring.

* * * * *